US007918360B2

(12) United States Patent
Mengeu et al.

(10) Patent No.: US 7,918,360 B2
(45) Date of Patent: Apr. 5, 2011

(54) CONTAINER WITH OVERCAP

(75) Inventors: Gary L. Mengeu, Wheeling, WV (US); Stephen B. Getsy, Bridgeville, PA (US)

(73) Assignee: Silgan Plastics Corporation, Chesterfield, MO (US)

( * ) Notice: Subject to any disclaimer, the term of this patent is extended or adjusted under 35 U.S.C. 154(b) by 433 days.

(21) Appl. No.: 12/078,481

(22) Filed: Apr. 1, 2008

(65) Prior Publication Data

US 2009/0223967 A1 Sep. 10, 2009

Related U.S. Application Data

(63) Continuation-in-part of application No. 12/075,028, filed on Mar. 7, 2008, now abandoned.

(51) Int. Cl.
*B65D 45/16* (2006.01)

(52) U.S. Cl. ..... 220/324; 220/784

(58) Field of Classification Search ..... 220/326, 220/624, 615, 784, 783, 780, 793, 367.1, 220/805, 797, 796, 658, 657, 656, FOR. 109, 220/FOR. 107, FOR. 105, 212.5, 285, 284, 220/260; 215/307, 605, 295, 284, 280, 273, 215/310, 224, 216, 215, 206, 228, 201, 200, 215/225; D9/443, 435; *B65D 45/20, 45/18, B65D 45/16*

See application file for complete search history.

(56) References Cited

U.S. PATENT DOCUMENTS 1,413,257 A 4/1922 Carvalho
1,908,245 A 5/1933 Hogg
2,162,752 A 6/1939 Schauer
2,700,186 A 1/1955 Stover
3,065,875 A * 11/1962 Negoro ..... 220/784
3,163,310 A 12/1964 Blakslee
3,307,728 A 3/1967 Elser
3,329,293 A 7/1967 Baumbach
3,338,444 A 8/1967 Velt
3,603,472 A 9/1971 Lecimski, Jr. et al.
3,612,323 A 10/1971 Malick
3,642,161 A 2/1972 Stroud
3,688,942 A * 9/1972 Mitchell et al. ..... 220/784
3,733,001 A 5/1973 Gach
3,739,934 A 6/1973 Bruno
3,790,015 A 2/1974 Imamura
3,817,419 A * 6/1974 Moller et al. ..... 220/315
3,820,678 A 6/1974 Zipper et al.
3,875,654 A 4/1975 Ushijima
3,913,771 A 10/1975 Acton et al.
3,920,141 A 11/1975 Bojardi
3,930,588 A 1/1976 Coursaut
4,133,462 A 1/1979 Lindström
4,227,618 A 10/1980 Zipper
4,330,067 A 5/1982 Deussen
4,340,149 A 7/1982 Mori et al.
4,364,483 A 12/1982 Golde
4,368,828 A 1/1983 Samuel et al.

(Continued)

*Primary Examiner* — Anthony Stashick
*Assistant Examiner* — Robert J Hicks
(74) *Attorney, Agent, or Firm* — Reinhart Boerner Van Deuren s.c.

(57) ABSTRACT

A closure for a microwavable container has a top wall and a skirt with at least one tab formed of a pair of straps and a thumb grip. The tab has an internal bead extending about its inner periphery which provides a shoulder which abuts a shoulder on the bead of the container to retain the closure on the container. The tab can be gripped by the user's thumb to apply force outwardly and upwardly to disengage the internal bead.

10 Claims, 19 Drawing Sheets

U.S. PATENT DOCUMENTS 4,413,742 A 11/1983 Sandhaus
4,423,822 A * 1/1984 Powalowski ..... 215/365
4,478,343 A 10/1984 Ostrowsky
4,480,762 A * 11/1984 Thomas ..... 215/273
4,493,427 A 1/1985 Wolkonsky
4,511,053 A 4/1985 Brandes
4,535,905 A 8/1985 Sandhaus
4,560,076 A 12/1985 Boik
4,572,388 A 2/1986 Luker et al.
4,610,367 A 9/1986 Massott et al.
4,679,696 A 7/1987 Bonnenfant et al.
4,694,969 A 9/1987 Granat
4,694,970 A 9/1987 Hayes
4,705,188 A 11/1987 Rahn
4,721,219 A 1/1988 Dullabaun et al.
4,746,026 A 5/1988 Leonhardt
4,752,013 A * 6/1988 Miller et al. ..... 215/216
4,787,530 A 11/1988 Edwards
4,801,029 A 1/1989 Begley
4,801,030 A 1/1989 Barriac
4,813,561 A 3/1989 Ochs
4,851,176 A 7/1989 Christiansen et al.
4,966,302 A 10/1990 Hjordie
4,978,016 A 12/1990 Hayes
4,981,230 A 1/1991 Marshall et al.
4,989,740 A 2/1991 Vercillo
4,993,570 A 2/1991 Julian et al.
5,007,545 A 4/1991 Imbery, Jr.
5,076,453 A 12/1991 Odet
5,078,290 A 1/1992 Ochs
5,115,928 A 5/1992 Drummond, Jr.
5,145,078 A 9/1992 Hannon et al.
5,160,687 A 11/1992 Margaria
5,205,424 A 4/1993 Gaspar
5,234,118 A 8/1993 Fillmore et al.
5,236,107 A 8/1993 Spaanstra, Sr.
5,427,266 A 6/1995 Yun
5,449,077 A 9/1995 Seidler
5,450,973 A 9/1995 Ellis et al.
5,460,287 A * 10/1995 Cargile et al. ..... 220/276
5,509,550 A 4/1996 DeJohnge
5,538,154 A * 7/1996 Von Holdt ..... 220/277
D374,822 S 10/1996 Philips
5,597,083 A 1/1997 Childers et al.
5,685,443 A 11/1997 Taber et al.
5,785,179 A * 7/1998 Buczwinski et al. ..... 206/494
5,860,543 A 1/1999 Decelles
5,865,330 A 2/1999 Buono
5,931,333 A 8/1999 Woodnorth et al.
6,035,769 A 3/2000 Nomura et al.
6,161,711 A 12/2000 Miceli et al.
6,168,044 B1 * 1/2001 Zettle et al. ..... 220/784
6,207,100 B1 3/2001 Weiss et al.
6,230,924 B1 5/2001 Weiss et al.
6,439,409 B1 8/2002 Dressel et al.
6,612,450 B1 9/2003 Buono
6,645,539 B2 11/2003 Bukowski et al.
6,880,729 B2 4/2005 Stull et al.
7,028,858 B2 4/2006 Auer et al.
D527,633 S 9/2006 Stull et al.
7,112,771 B2 9/2006 Richardson et al.
7,152,763 B2 12/2006 Stull et al.
D540,677 S 4/2007 Stull
2002/0190067 A1 * 12/2002 Getsy ..... 220/256.1
2003/0155322 A1 8/2003 Auer et al.
2004/0007595 A1 1/2004 Stull et al.
2004/0195241 A1 10/2004 Stull et al.
2005/0145627 A1 7/2005 Stull et al.
2006/0006202 A1 1/2006 Stull et al.
2006/0006203 A1 1/2006 Stull et al.
2006/0070999 A1 4/2006 Stull et al.
2006/0091140 A1 5/2006 Perry et al.
2006/0266751 A1 11/2006 Ali et al.
2007/0164027 A1 7/2007 Auer
2007/0251913 A1 11/2007 Mengeu
2009/0218360 A1 * 9/2009 Suk ..... 220/784

* cited by examiner

CONTAINER WITH OVERCAP

CROSS REFERENCE TO RELATED APPLICATION

The present application is a continuation-in-part of U.S. patent application Ser. No. 12/075,028 filed Mar. 7, 2008 now abandoned.

BACKGROUND OF THE INVENTION

The present invention relates to container closures and, more particularly, to a closure which may be readily removed and reinstalled.

The increasing use of closures which are used to replace sealed covers on containers has created a demand for closures which can be readily removed from and repeatably reassembled with the container. Moreover, the extensive use of microwaveable packaging for foods has generated a need for closures which may be used on food containers to be microwaved when the metal lid, foil or plastic seal is removed so that the contents may be vented.

U.S. Patent Publication 2004/0195241 to Stull illustrates a venting removable closure for a microwavable container containing foodstuffs. This closure relies upon the user's hand applying a compressive force on a pair of upstanding portions or tabs to deflect levers and disengage the levers from the bead on the container. This construction relies on thin sections to enable the pivoting of the levers and thus, the levers have reduced holding power after the closure has been microwaved.

It is an object of the present invention to provide a novel synthetic resin closure which may be applied to a container after the seal has been removed.

It is also an object to provide such a closure which may be readily fabricated and which can be removed or reassembled while still providing secure engagement with the container after it has been subject to microwave energy.

Another object is to provide such a closure which provides an insulating surface to avoid burning of the user's finger.

SUMMARY OF THE INVENTION

It has now been found that the foregoing and related objects may be readily attained in a snap-on closure for use with a container having a circumferential bead providing a generally horizontal, downwardly facing shoulder. The closure has a top wall and a skirt extending thereabout, and the skirt has at least one deflectable tab defined by a pair of circumferentially spaced slots and a central cutout extending into the top wall to provide a pair of straps and a thumb grip therebetween. The tab has an internal bead extending about its internal periphery and providing a generally horizontal, upwardly facing ledge dimensioned and configured to snap under the shoulder of the container bead. The shoulders abut to secure the cap on the container, and the tab is deflectable outwardly and upwardly by applying force upwardly and outwardly on the thumb grip to disengage the internal bead from the container shoulder.

Preferably, the lower surface of the top wall has a reinforcing ring extending about the interior of the top wall and spaced from the skirt, and this ring extends into the straps. The closure also has spaced ribs extending between the ring and skirt to stiffen the closure.

In a preferred embodiment, the tab has a guard projection extending upwardly from the thumb grip portion of the tab to prevent the user's finger from making contact with the hot bead on the container when it is removed from the microwave.

Usually, the top wall has a multiplicity of apertures therein to vent gases from the contents of the container, and the skirt has a pair of diametrically spaced tabs.

DETAILED DESCRIPTION OF THE ILLUSTRATED EMBODIMENTS

Figure 1:
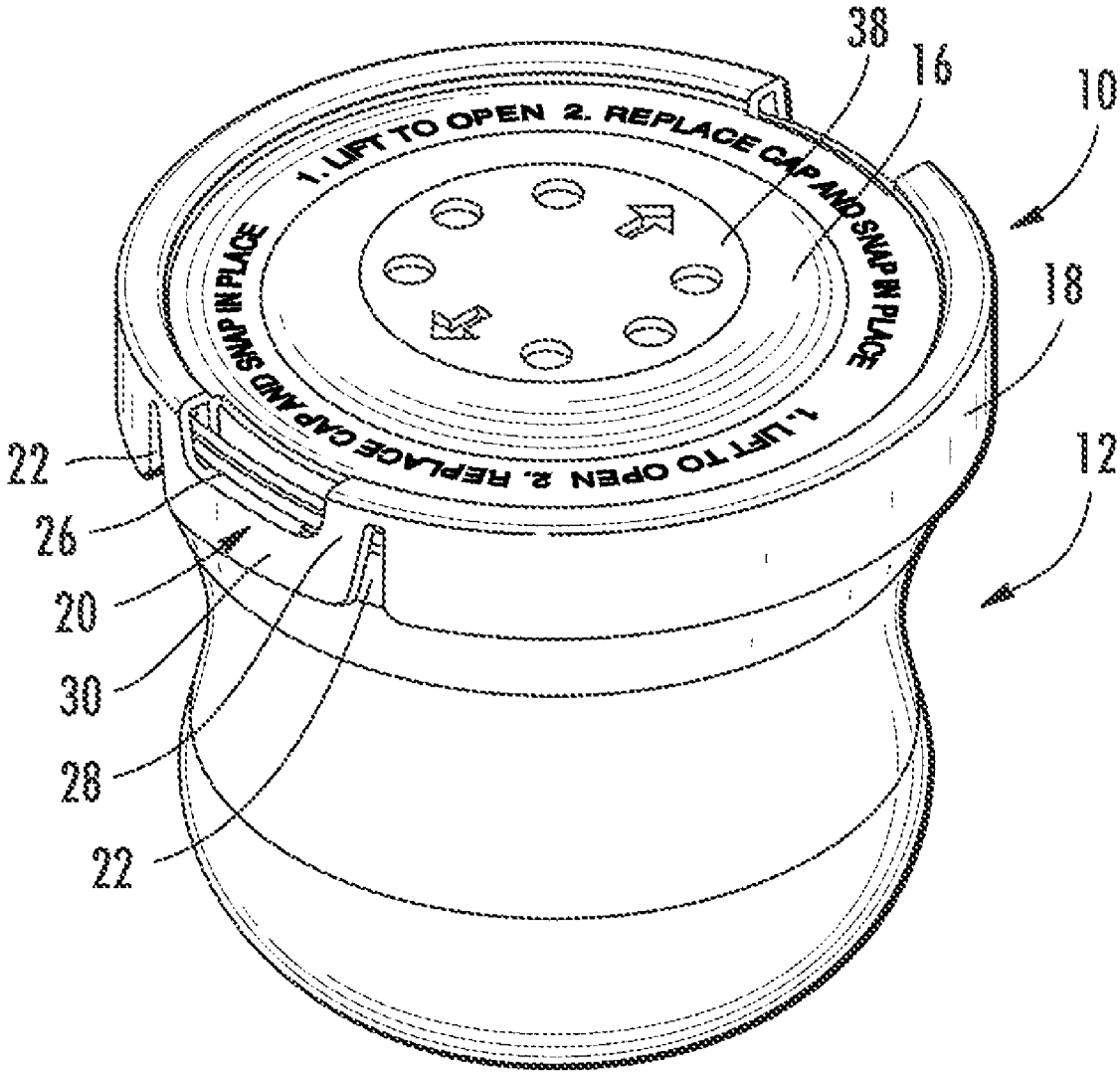
FIG. 1 is a perspective view of a two tab closure embodying the present invention as mounted upon a container having a circumferential bead.
Figure 2:
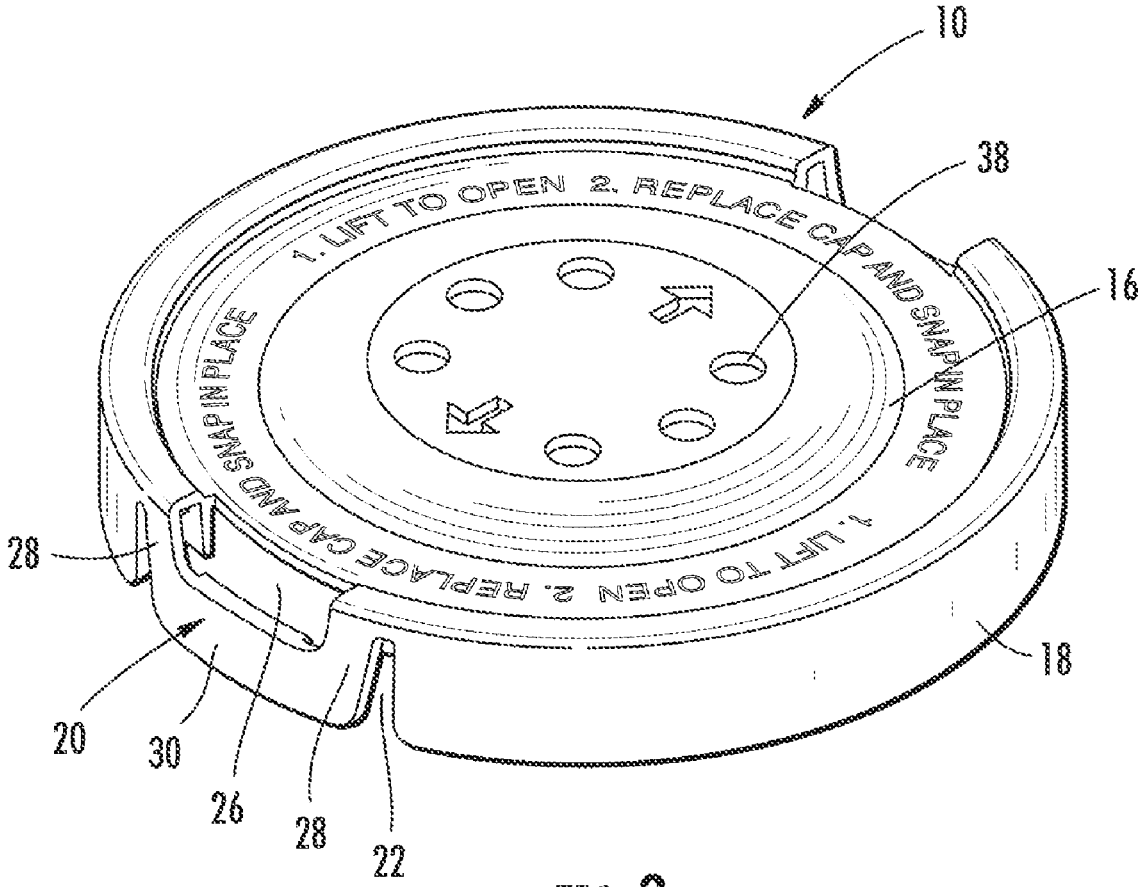
FIG. 2 is a top perspective view of the closure and drawn to an enlarged scale.
Figure 3:
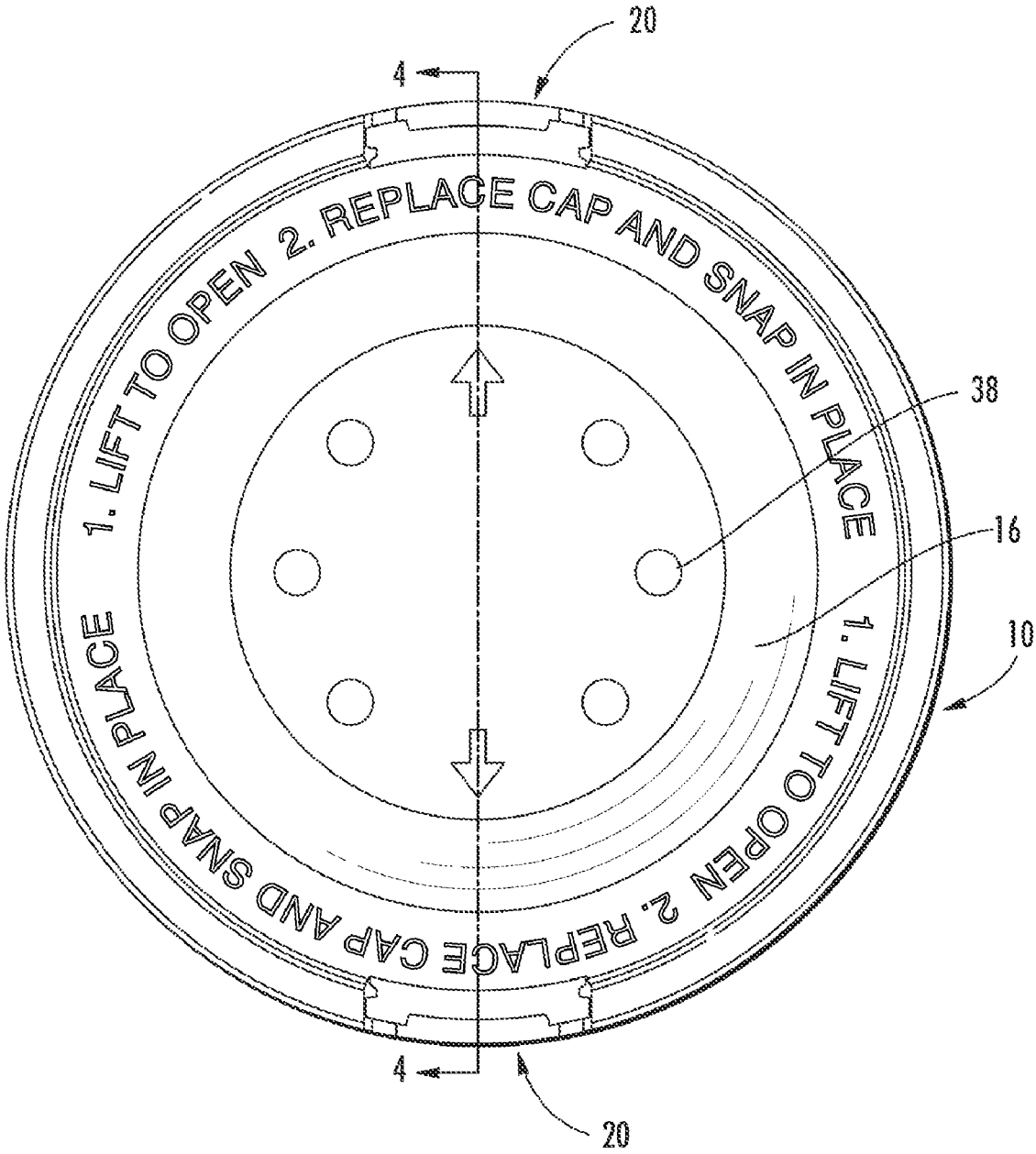
FIG. 3 is a top plan view of the closure.
Figure 9:
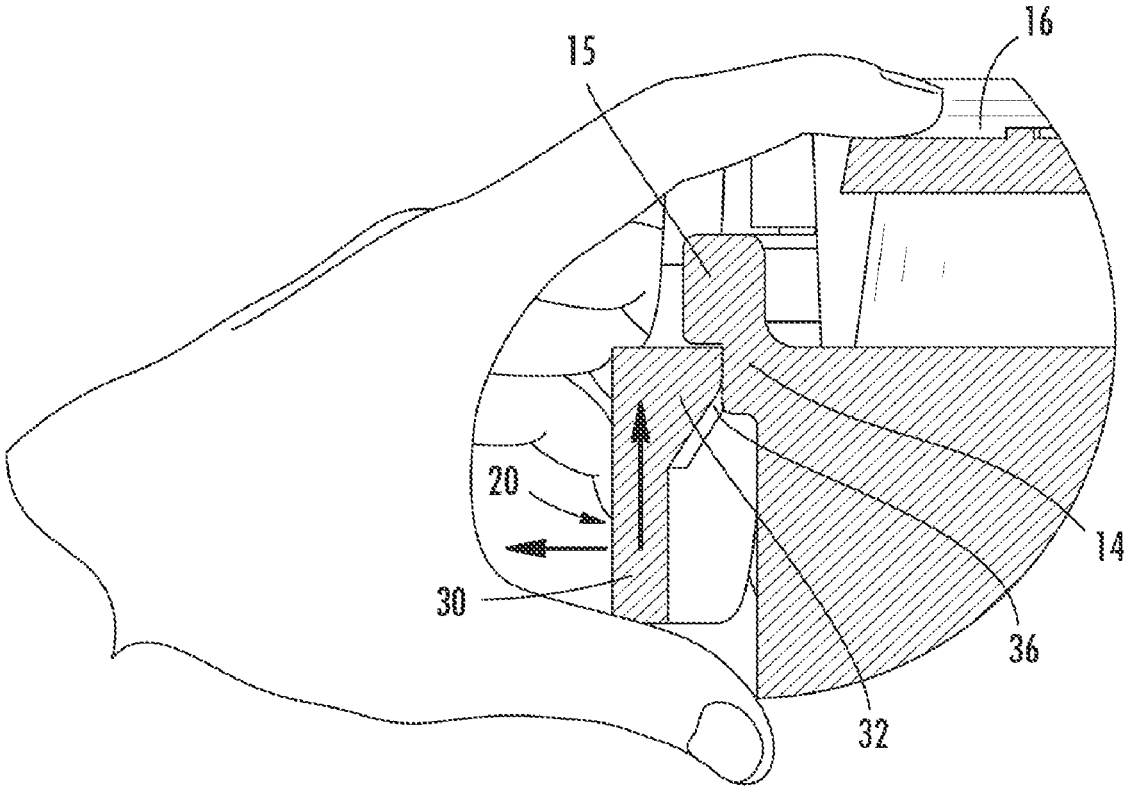
FIG. 9 is a diagrammatic view of the container assembly showing the user's fingers placed on the closure to deflect the tab with arrows showing the forces applied thereto to disengage the tab from the container bead.
Figure 10:
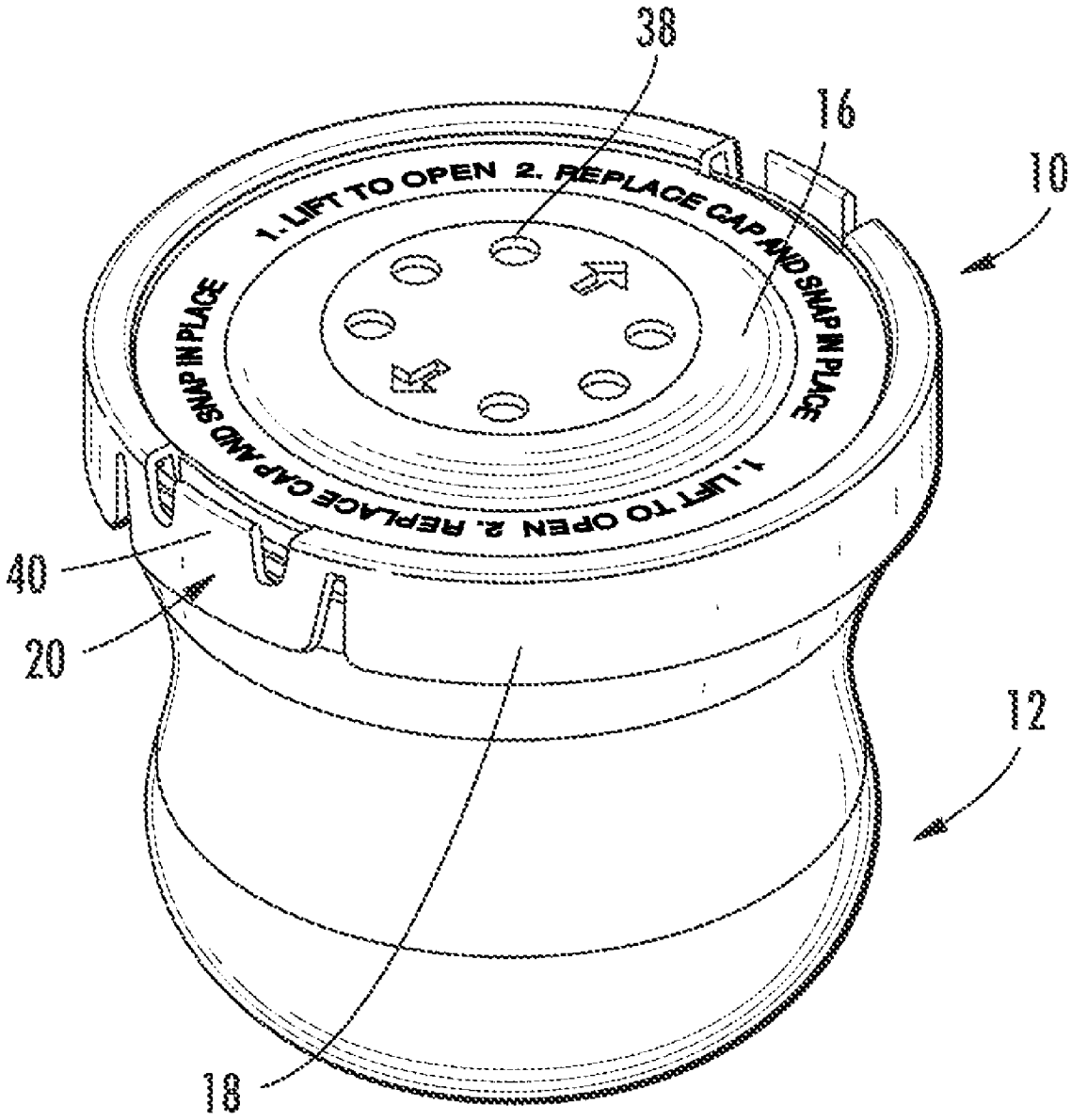
FIG. 10 is a perspective view of a container assembly with another embodiment of the closure of the present invention.
Figure 11:
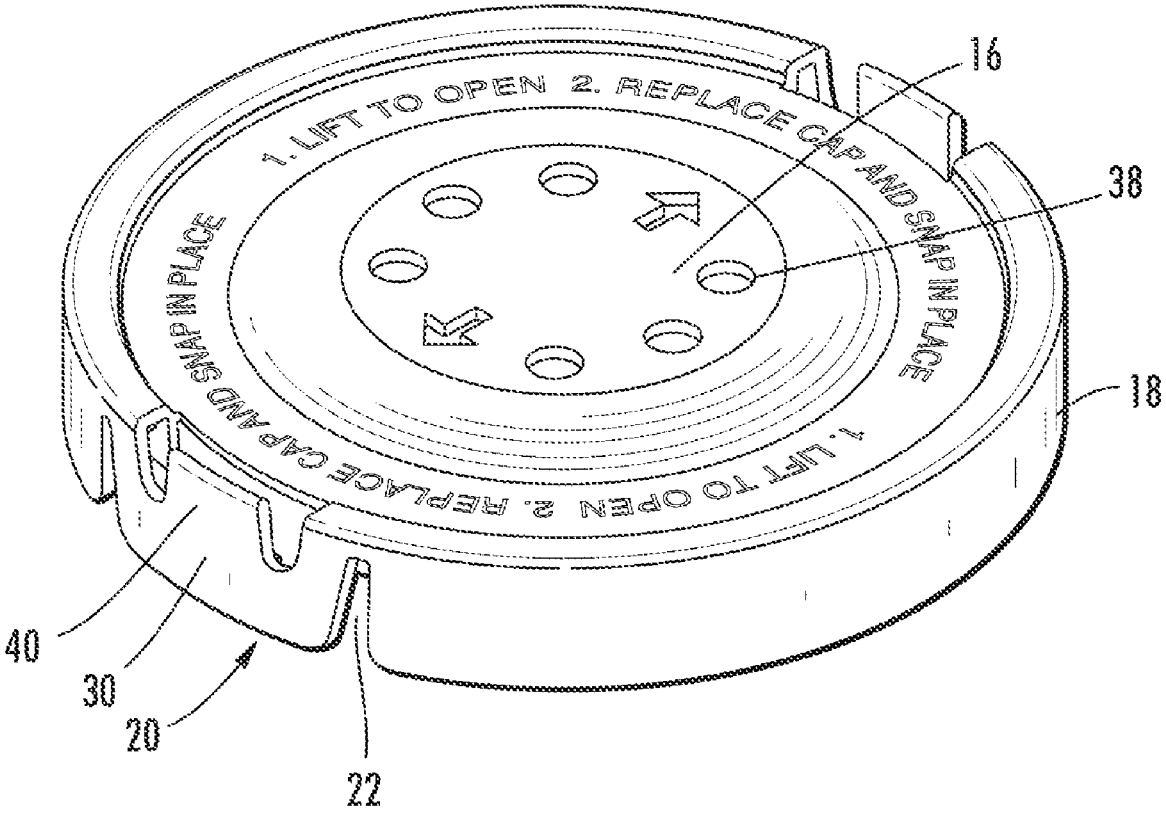
FIG. 11 is a top perspective view of the closure embodiment of FIG. 10.
Figure 12:
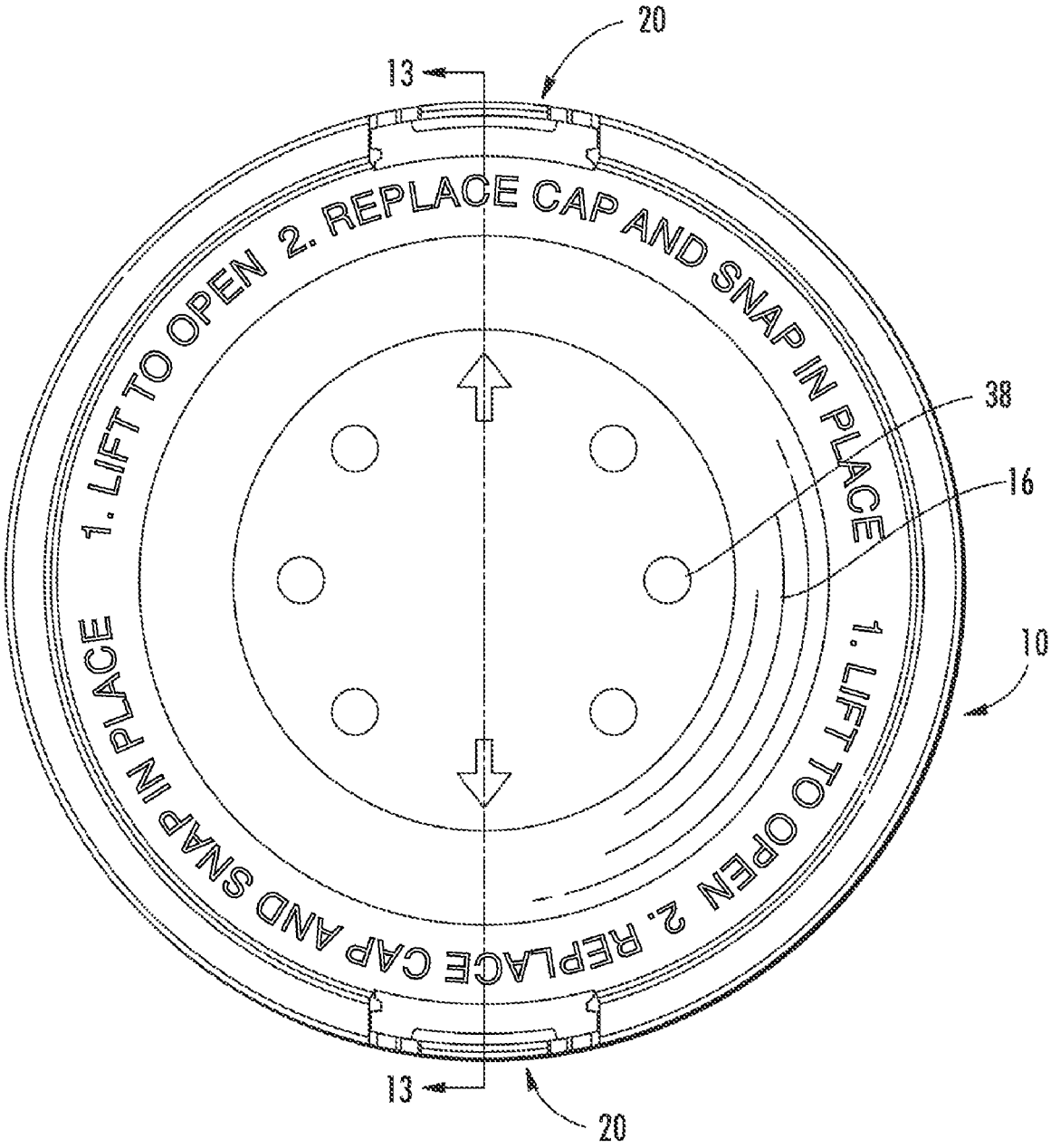
FIG. 12 is a top plan view of the closure.
Figure 13:
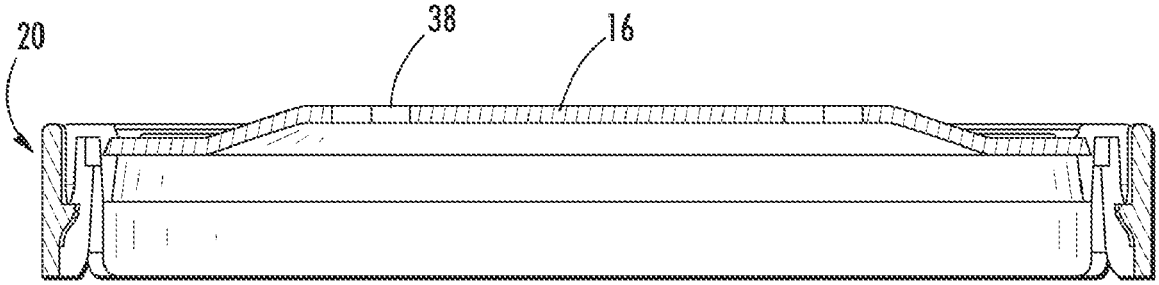
FIG. 13 is a cross sectional view along the line 13-13 in FIG. 12.
Figure 14:
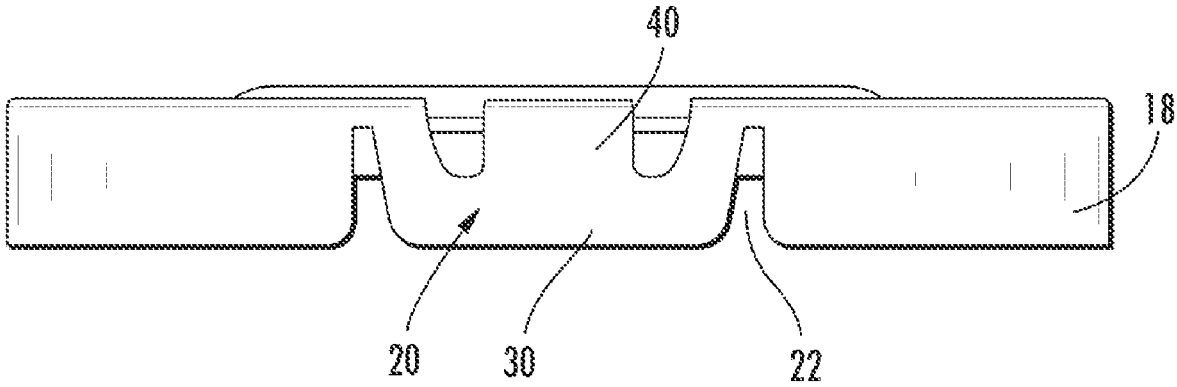
FIG. 14 is a side elevational view thereof.
Figure 15:
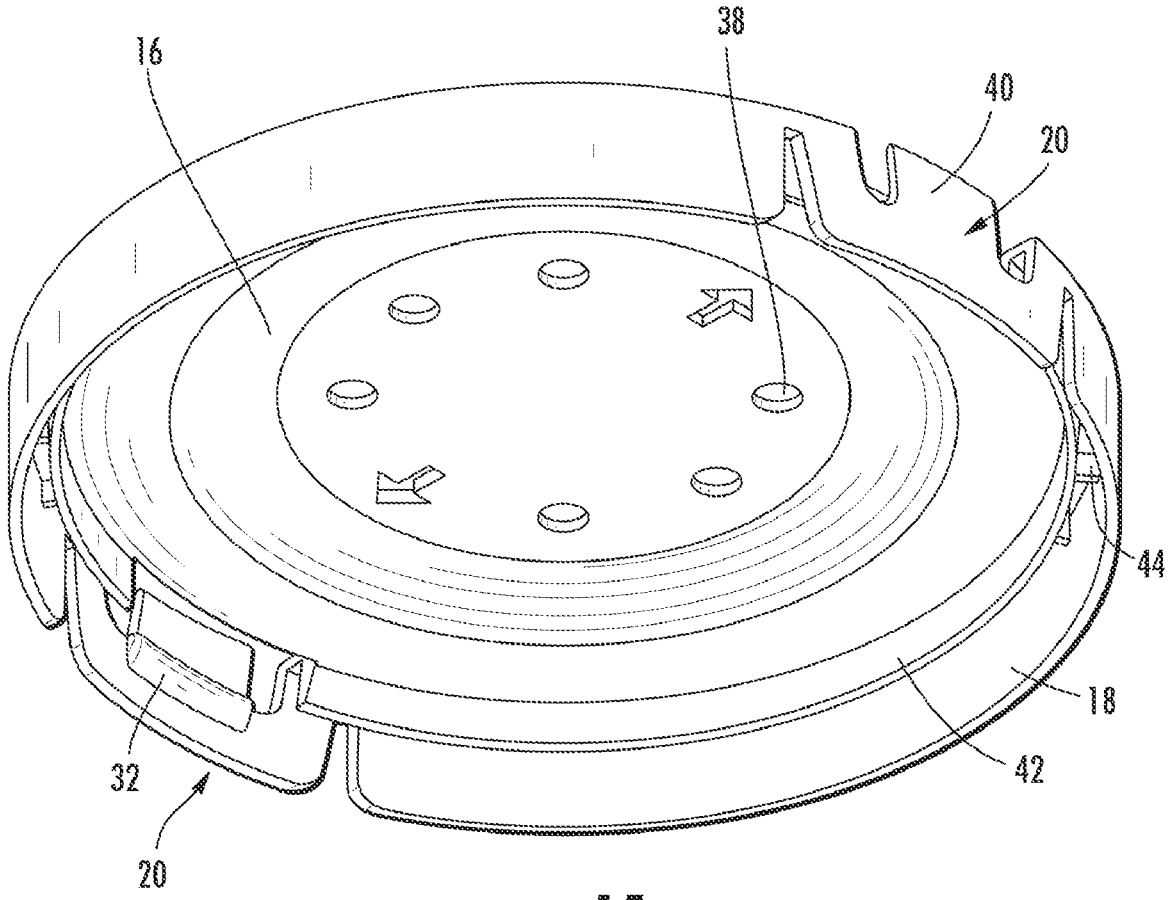
FIG. 15 is a bottom perspective view thereof.
Figure 16:
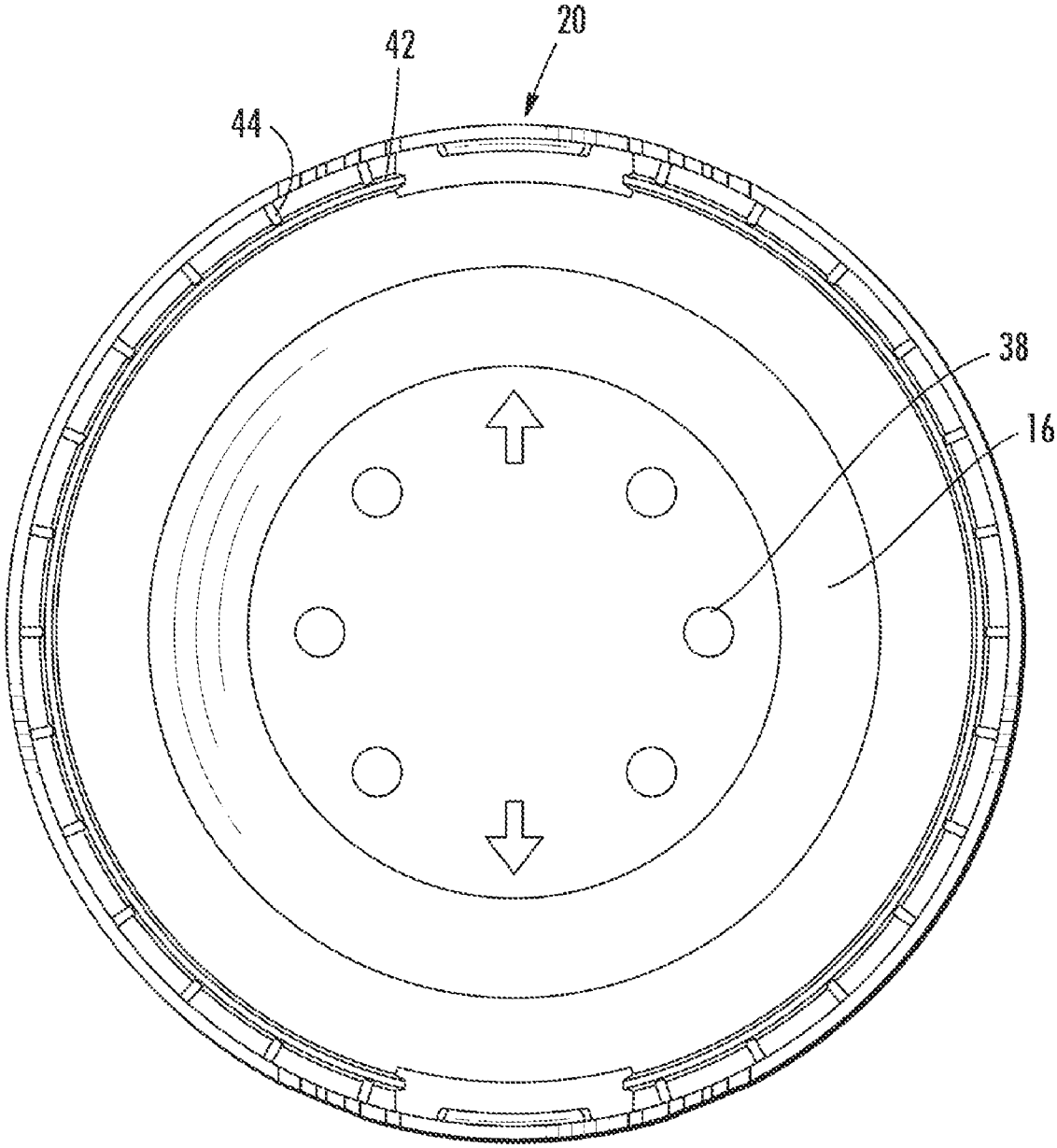
FIG. 16 is a bottom view thereof.
Figure 17:
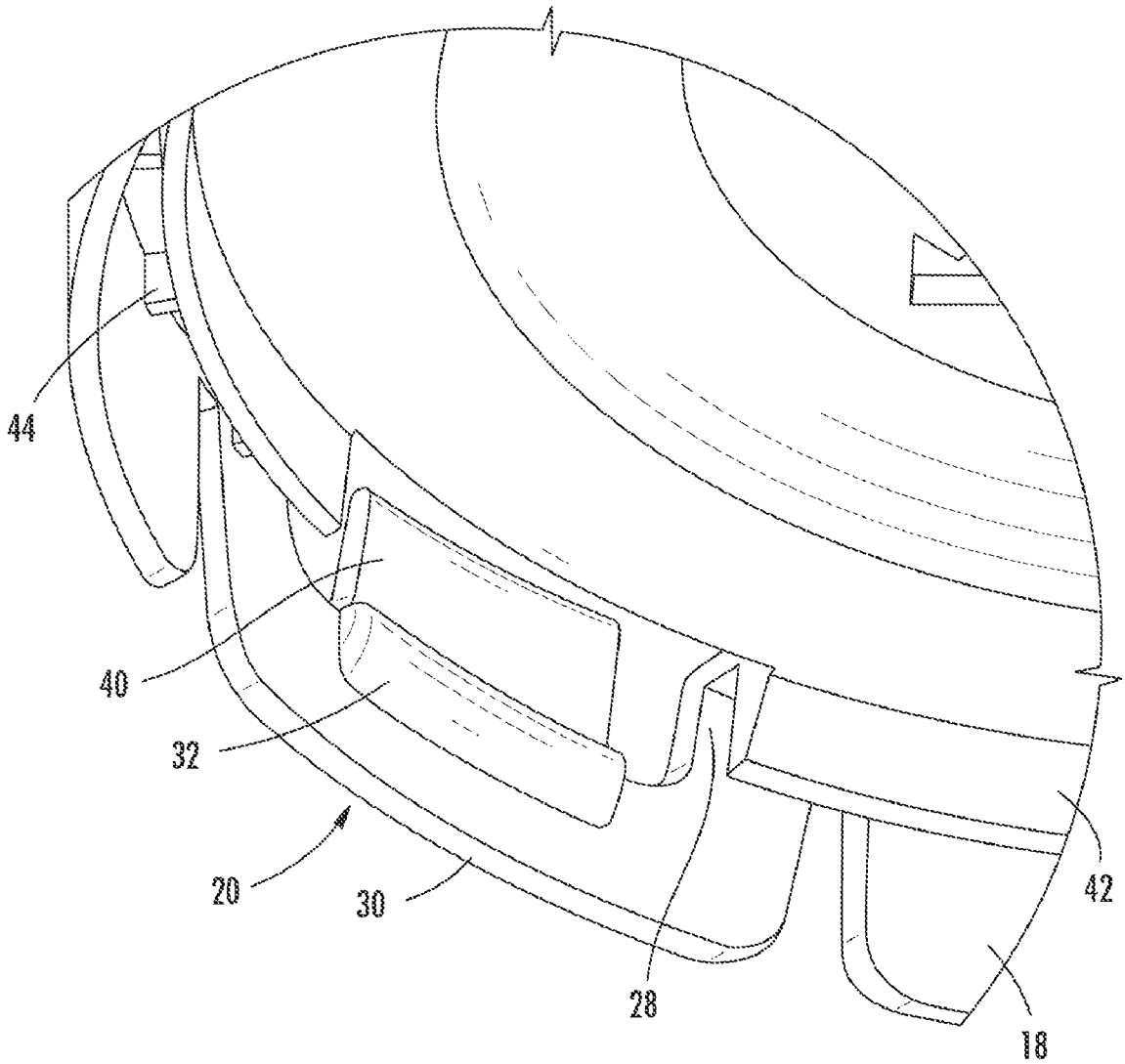
FIG. 17 is a perspective sectional view thereof drawn to an enlarged scale.
Figure 18:
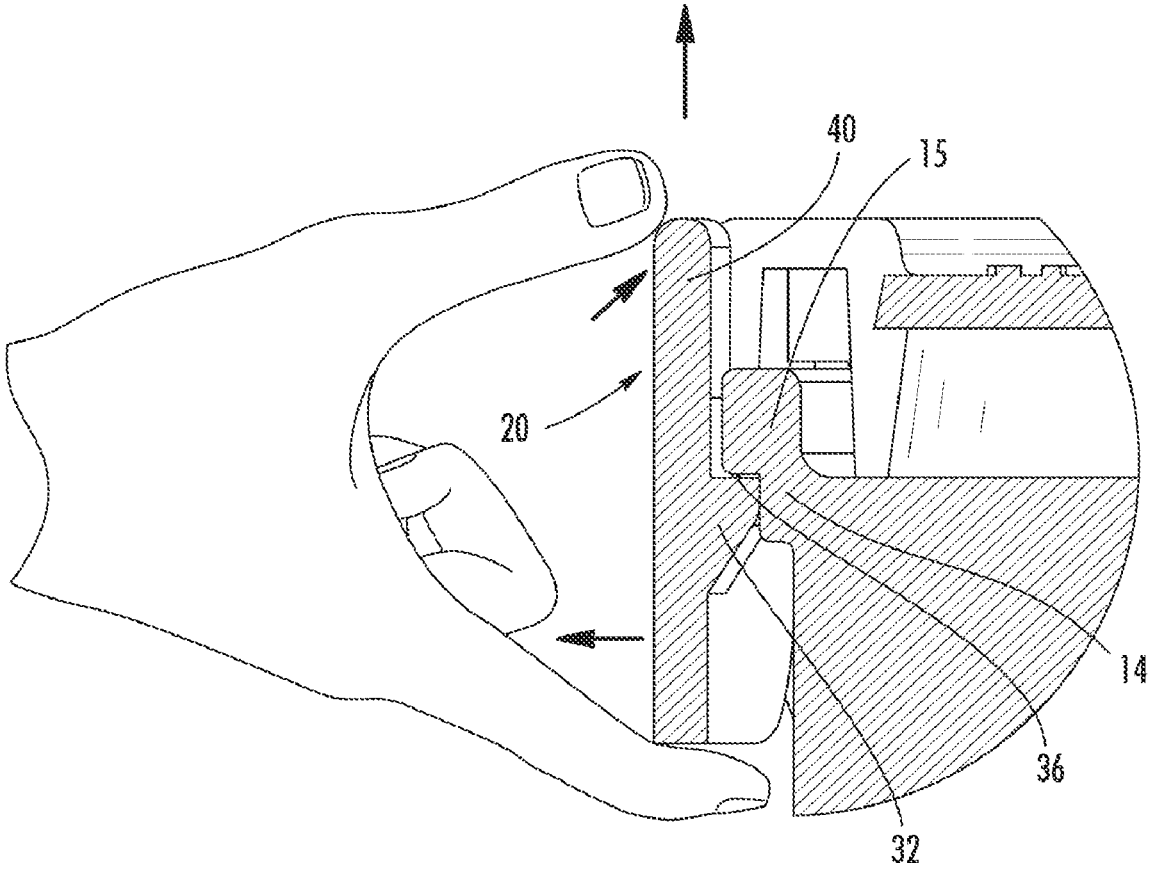
FIG. 18 is a diagrammatic view showing the user's fingers placed on the tab to deflect the tab with arrows showing the forces applied thereto to disengage the tab from the container bead.
Figure 19:
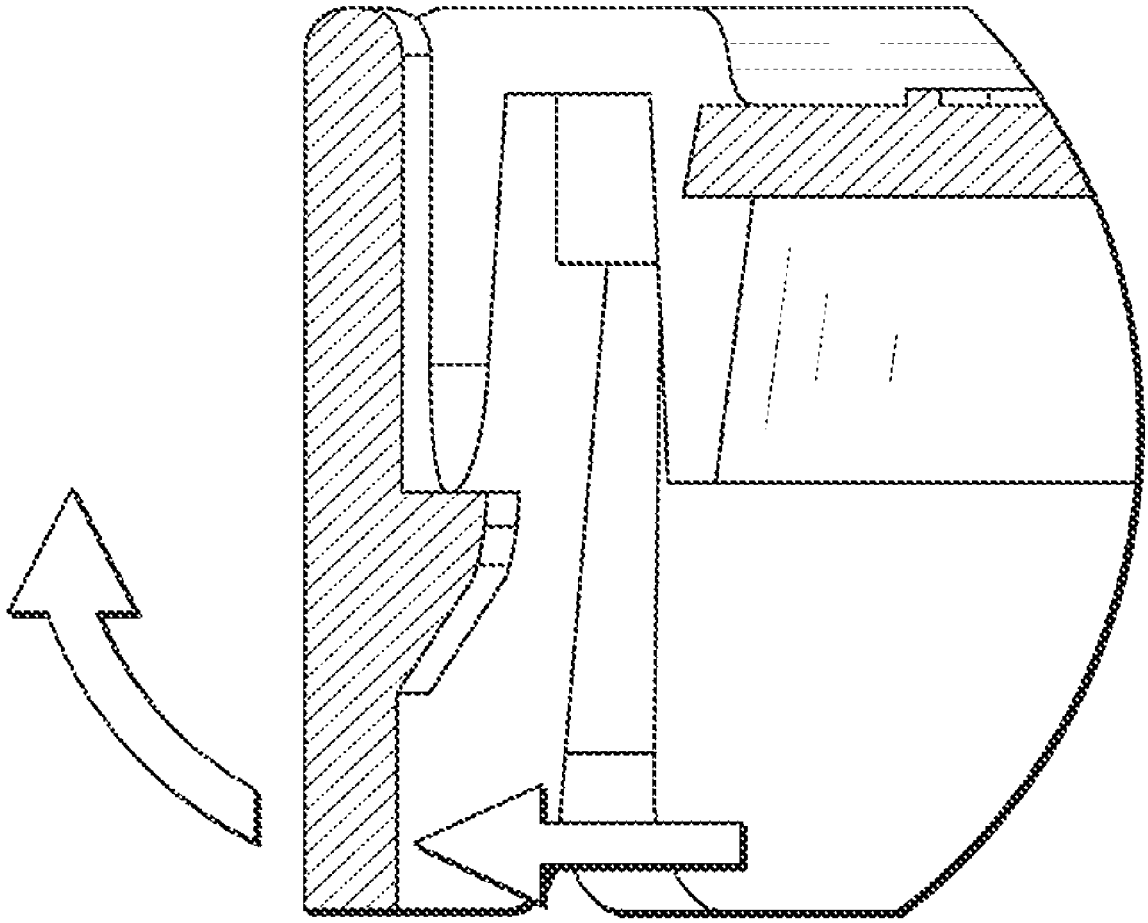
FIG. 19 is another diagrammatic view with arrows showing the forces applied thereto.

Turning first to FIG. 1 of the attached drawings, therein illustrated is a closure generally designated by the numeral 10 and embodying the present invention as mounted upon a container generally designated by the numeral 12 and having a circumferential bead 14 with a downwardly facing horizontal shoulder 15 (seen in FIG. 9).

The closure 10 has a top wall 16 and a peripheral skirt 18 with a pair of tabs generally designated by the numerical 20 and diametrically spaced apart. The tabs 20 are formed by a pair of circumferentially spaced slots or notches 22 in the skirt 18 and a cutout 26 therebetween that extends into the top wall 16. The slots 22 and the cutout 26 thus provide tabs 20 with a pair of strap portions 28 and a thumb grip 30.

Figure 4:
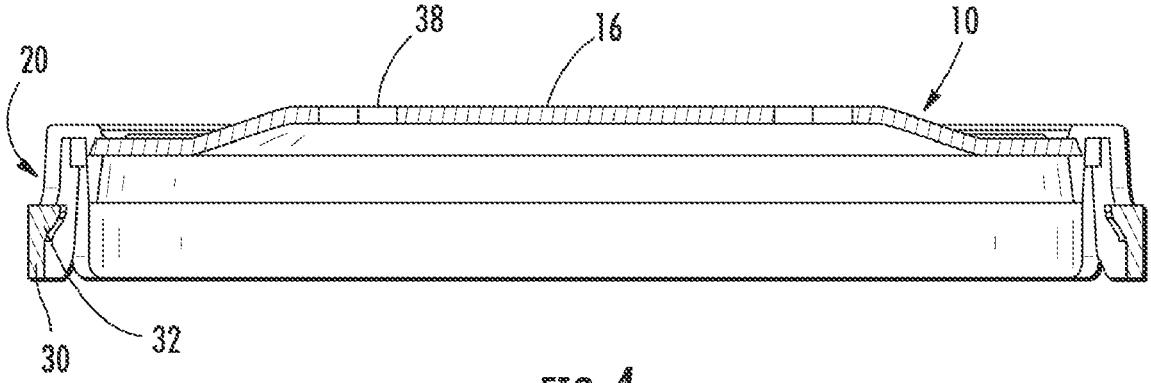
FIG. 4 is a cross sectional view along the line 4-4 in FIG. 3.
Figure 5:
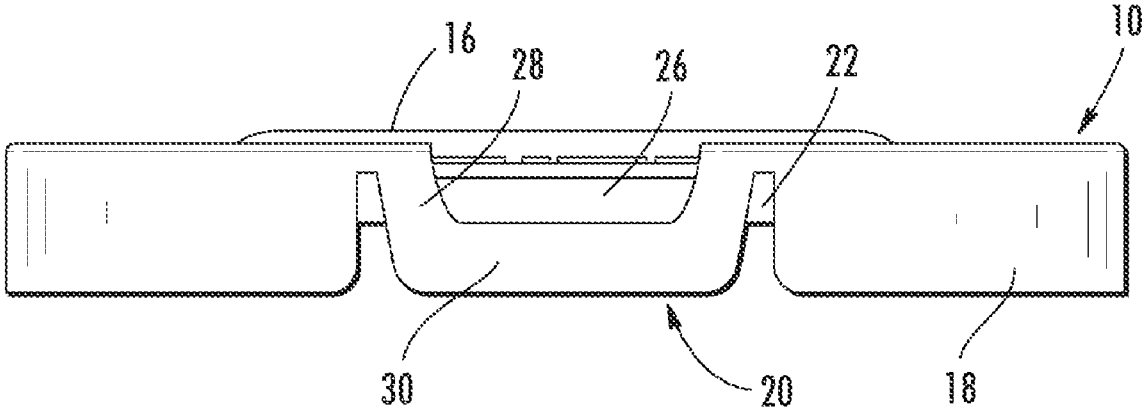
FIG. 5 is a side elevational view thereof.
Figure 6:
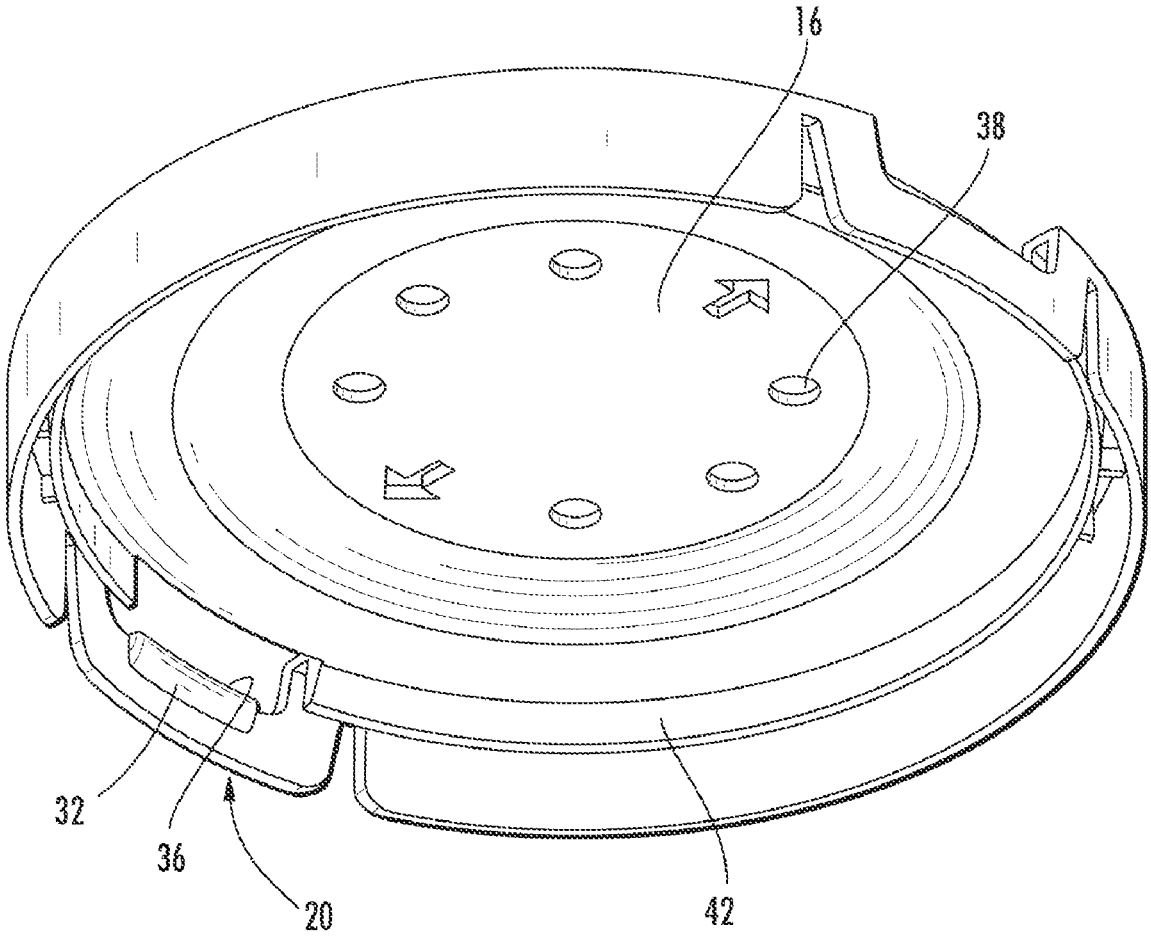
FIG. 6 is a bottom perspective view thereof.

As seen in FIG. 6, the tab 20 has an internal bead 32 with an upwardly facing horizontal shoulder 36 which abuts the downwardly facing horizontal shoulder 15 on the bead 14 of the container 12. The inner surface of the bead 32 tapers upwardly and inwardly as best seen in FIG. 4. The tab 20 is configured and dimensioned to enable gripping of the closure 10 between the thumb grip 30 and the top wall 16. The thumb applies an outward and upward force on the internal bead 32 to disengage the internal bead 32 of the tab 20 from the container bead 14. The user can then lift the closure 10 from the container 12.

Figure 7:
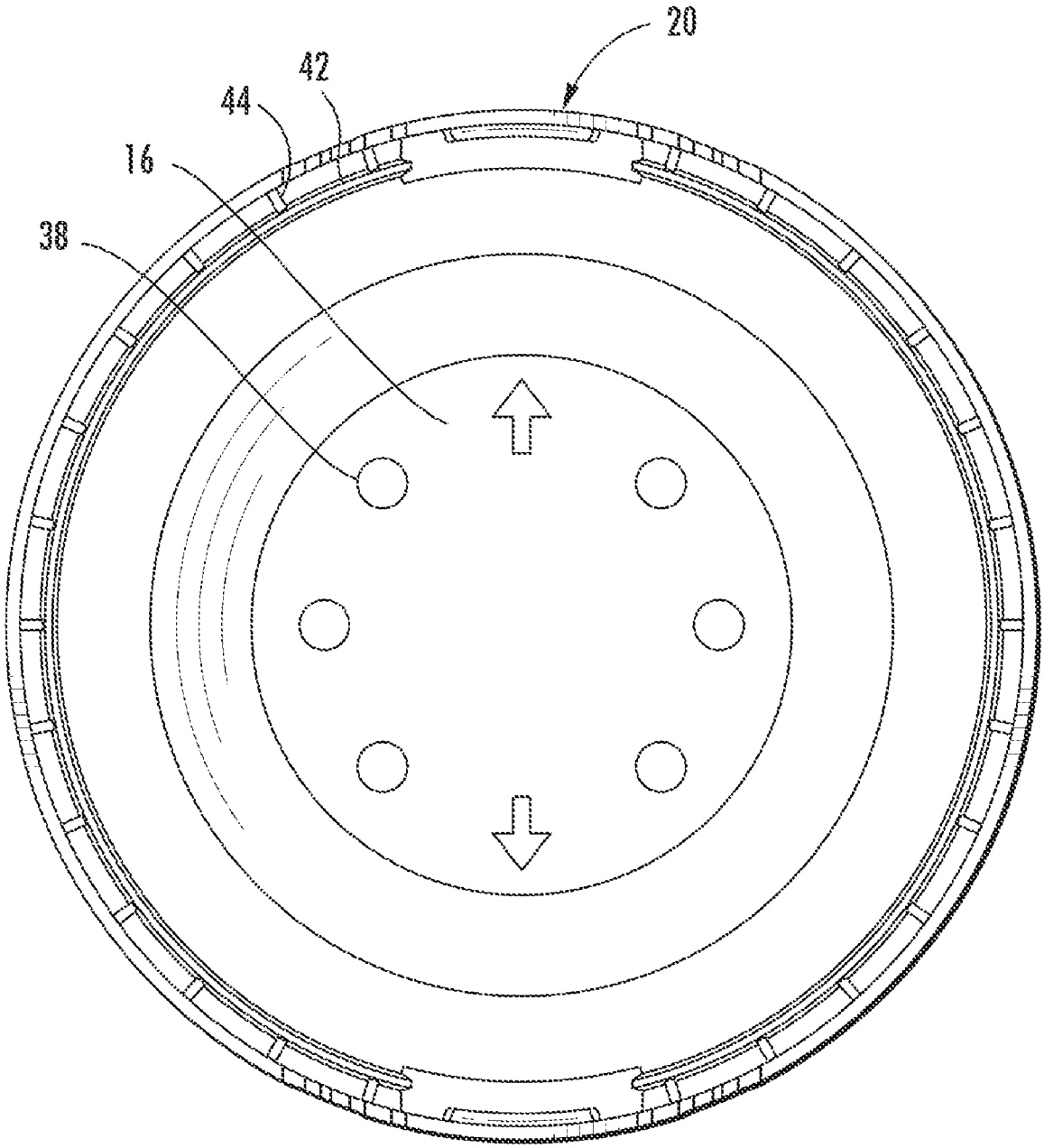
FIG. 7 is a bottom view thereof.
Figure 8:
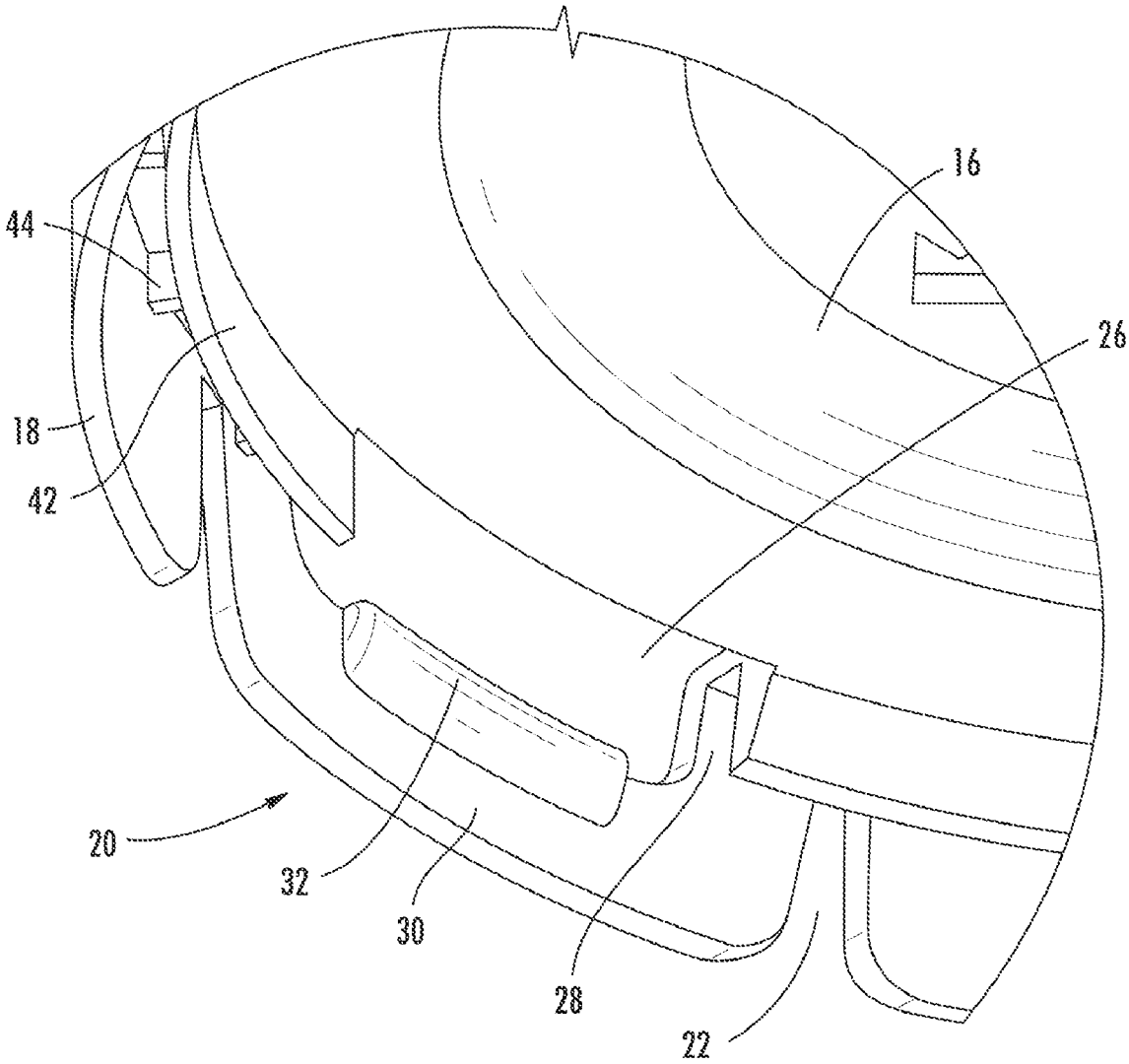
FIG. 8 is a perspective sectional view thereof drawn to an enlarged scale.

As best seen in FIGS. 6 and 7, the bottom surface of the top wall 16 has a ring or annular rib 42 which extends therebout and ribs 44 extend between the ring 42 and the skirt 18. The ring 42 and the ribs 44 extend into the straps 28 of the tab 20. This stiffens the skirt and the tabs.

As seen in FIG. 9, the user's thumb is placed under the thumb grip 30 and the user's index finger bears on the top wall 16 of the closure 10. Pressure is applied to flex the tab 20 outwardly and upwardly as seen in FIG. 9. This causes the shoulder 36 on the tab 20 to flex outwardly to disengage the shoulders 15, 36 and this allows the upward pressure of the thumb to release the entire closure 10 the container 12.

The closure 10 may be readily snapped onto the container 12 by applying a downward force on the tab 20. The thickness of the tab components enables repeated removal and replacement.

Desirably, the top wall 16 has a multiplicity of apertures 38 to vent gases from the contents of the container 12 during exposure to microwave radiation.

The construction of the embodiment of FIGS. 10-19 is essentially that of FIGS. 1-9 except that there is a guard projection 40 which extends upwardly from the thumb grip 30 and provides a guard to preclude the user's finger from coming into contact with the metallic bead on the container which can be quite hot when the container is removed from the microwave heater.

Although various resins may be employed for the closure, polypropylene has desirable properties and relatively low cost.

Although a single tab may be used, two diametrically spaced tabs allows the user to use two hands to reduce the force necessary to deflect the tabs and release the closure.

Thus, it can be seen from the foregoing description and attached drawings that the present invention provides a novel microwavable closure which may be securely engaged and reengaged with the container and readily removable with one hand.

Having thus described the invention, what is claimed is:

1. A snap-on closure, the closure configured for use with a container having a circumferential container bead providing a generally horizontal downwardly facing shoulder, wherein the closure comprises: a top wall and a skirt extending thereabout, said skirt having at least one deflectable tab defined by a pair of circumferentially spaced slots and a central cutout extending into said top wall to provide a pair of straps and a thumb grip, said tab having an internal bead extending about the internal periphery of the tab and providing a generally horizontal upwardly facing shoulder dimensioned and configured to snap under the shoulder of the container bead, said shoulders abutting to secure said closure on the container, and said tab being deflectable outwardly and upwardly by applying force upwardly and outwardly on the thumb grip to disengage the internal bead from the container shoulder.

2. The snap-on closure in accordance with claim 1 wherein said top wall has a ring extending about the lower surface of said top wall and spaced from said skirt, said ring extending into said straps of said tab.

3. The snap-on closure in accordance with claim 2 wherein said closure has spaced ribs between said ring and said skirt to stiffen the closure.

4. The snap-on closure in accordance with claim 1 wherein said top wall has a multiplicity of apertures therein to vent gases from the contents of the container.

5. The snap-on closure in accordance with claim 1 wherein said skirt has a pair of diametrically spaced tabs.

6. The snap-on closure in accordance with claim 1 wherein said tab has a guard projection extending upwardly from said thumb grip to prevent a user's finger from coming into contact with the container bead.

7. A container assembly including a container having a circumferential container bead providing a downwardly facing horizontal shoulder and a closure having a top wall and a skirt extending thereabout, said skirt having at least one deflectable tab defined by a pair of circumferentially spaced slots and a central cutout extending into said top wall to provide a pair of straps and a thumb grip, said tab having an internal bead extending about the internal periphery of the tab and providing a generally horizontal upwardly facing shoulder dimensioned and configured to snap under the shoulder of the container bead, said shoulders abutting to secure said cap on the container, and said tab being deflectable outwardly and upwardly by applying force upwardly and outwardly on the thumb grip to disengage the internal bead from the container shoulder.

8. The container assembly in accordance with claim 7 wherein said tab has a guard projection extending upwardly from said thumb grip to prevent a user's finger from coming into contact with the container bead.

9. The container assembly in accordance with claim 7 wherein said top wall has a ring extending about the lower surface of said top wall and spaced from said skirt, said ring extending into said straps of said tab, and said closure has spaced ribs between said ring and said skirt to stiffen the closure.

10. A container assembly including a container having a circumferential container bead providing a downwardly facing horizontal shoulder and a closure having a top wall and a skirt extending thereabout, said skirt having at least one deflectable tab defined by a pair of circumferentially spaced slots and a central cutout extending into said top wall to provide a pair of straps and a thumb grip, said tab having an internal bead extending about the internal periphery of the tab and providing a generally horizontal upwardly facing shoulder dimensioned and configured to snap under the shoulder of the container bead, said shoulders abutting to secure said cap on the container, and said tab being deflectable outwardly and upwardly by applying force upwardly and outwardly on the thumb grip to disengage the internal bead from the container shoulder, and said tab has a guard projection extending upwardly from said thumb grip to prevent a user's finger from coming into contact with the container bead.

* * * * *